US012617592B2

(12) United States Patent
Liang et al.

(10) Patent No.: US 12,617,592 B2
(45) Date of Patent: May 5, 2026

(54) STORAGE BOX WITH ADJUSTABLE AIR VENTS

(71) Applicant: Foshan Changfengpolang trade Co., LTD, Foshan (CN)

(72) Inventors: Rensheng Liang, Foshan (CN); Huiping Ye, Foshan (CN)

(73) Assignee: Foshan Changfengpolang trade Co., LTD, Foshan (CN)

( * ) Notice: Subject to any disclaimer, the term of this patent is extended or adjusted under 35 U.S.C. 154(b) by 0 days.

(21) Appl. No.: 18/822,658

(22) Filed: Sep. 3, 2024

(65) Prior Publication Data

US 2024/0425249 A1 Dec. 26, 2024

(30) Foreign Application Priority Data

Jan. 29, 2024 (CN) ..... 202420220858.8

(51) Int. Cl.
*B65D 51/16* (2006.01)

(52) U.S. Cl.
CPC ..... *B65D 51/16* (2013.01); *B65D 2205/02* (2013.01)

(58) Field of Classification Search
CPC ..... B65D 51/16; B65D 2205/02; A47J 47/12
See application file for complete search history.

(56) References Cited

U.S. PATENT DOCUMENTS

| | | | | |
|---|---|---|---|---|
| 854,569 | A * | 5/1907 | Curtice | A22C 21/0046 312/210.5 |
| 6,125,838 | A * | 10/2000 | Hedgpeth | A47J 37/0713 126/41 R |
| 6,707,009 | B1 * | 3/2004 | Ancona | A47J 47/12 99/357 |
| D957,887 | S * | 7/2022 | Zhao | D7/609 |
| 2013/0104745 | A1 * | 5/2013 | Stier | A47J 37/0731 99/421 R |
| 2021/0177203 | A1 * | 6/2021 | Ngo | A47J 37/0763 |
| 2022/0212839 | A1 | 7/2022 | Zhang et al. | |
| 2023/0174264 | A1 | 6/2023 | López Masagué et al. | |
| 2023/0174272 | A1 | 6/2023 | Taylor et al. | |

* cited by examiner

*Primary Examiner* — Shawn M Braden
(74) *Attorney, Agent, or Firm* — Hemisphere Law, PLLC

(57) ABSTRACT

The present invention discloses a storage box with adjustable air vents, the number or size of the first air vents exposed can be adjusted by rotating the rotary adjustment valve, and the number or size of the second air vents exposed can be adjusted by shifting the sliding adjustment valve, so that the ventilation volume of the air vents at two sides can be changed or even the air vents can be completely closed, and the freshness of bread can be further improved by controlling the convection of air flow to affect the change of air humidity. The rotary adjustment valve and the sliding adjustment valve both have a very simple structure, fewer parts and low cost, and are very convenient to mount, maintain and use.

9 Claims, 4 Drawing Sheets

STORAGE BOX WITH ADJUSTABLE AIR VENTS

TECHNICAL FIELD

The present invention relates to the technical field of storage tools, and in particular, to a storage box for placing foods such as bread.

BACKGROUND

Storage boxes are widely used in various industries. For example, in the food industry, there are storage boxes for storing foods such as bread and cakes. Such storage boxes generally comprise a box body and a box door. To keep foods fresh, some storage boxes need to be provided with air vents on the box body or the box door. Conventionally, one or more air vents are provided on the storage box for ventilation, which results in the inability to close the air vents when ventilation is not needed and the inability to adjust the ventilation volume of the air vents, thus causing inconvenience for use. Therefore, an adjusting mechanism is also designed for the air vents, the ventilation volume of the air vents at two sides can be adjusted through the adjusting mechanism, and even the air vents can be closed. However, the air vent adjustment mechanisms of such storage boxes currently have a complex structure, a large quantity of parts and high cost, and are not convenient to mount, maintain and use.

SUMMARY

The present invention is intended to solve the technical problems by providing a storage box with adjustable air vents, which has the advantages of a simpler structure, more reasonable design, fewer parts, lower cost and more convenient mounting, maintenance and use.

To solve the above technical problem, the present invention adopts the following technical solution: a storage box with adjustable air vents comprises a box body and a box door, wherein the box door is mounted on the box body, the box body is provided with first air vents arranged regularly; a rotary adjustment valve is arranged on the box body corresponding to the first air vents, and the first air vents are communicated with the inside of the box body; the rotary adjustment valve is provided with an opening opposite to the first air vents, and an overlapping area between the opening and the first air vents is changed by rotating the rotary adjustment valve, so as to form an adjusting structure for the ventilation volume of the first air vents; the box body is provided with second air vents and a sliding adjustment valve, and the second air vents are communicated with the inside of the box body; and the sliding adjustment valve is aligned with the second air vents, and an overlapping area between the sliding adjustment valve and the second air vents is changed by shifting the sliding adjustment valve, so as to form an adjusting structure for the ventilation volume of the second air vents.

Further, the box body comprises a bottom plate, a top plate and side plates, and the first air vents, the second air vents, the rotary adjustment valve and the sliding adjustment valve are all arranged on each of the side plates.

Further, each of the side plates is provided with a sliding groove, a plurality of the second air vents are provided as small round holes, the second air vents and the sliding adjustment valve are all arranged in the sliding groove, and a length of the sliding adjustment valve is less than that of the sliding groove.

Further, a plurality of the first air vents are provided as small round holes, and the second air vents are arranged on the side plate regularly.

Further, the sliding adjustment valve comprises a sliding cover and a magnetic attraction pad, the magnetic attraction pad is fixed on an inner surface of the sliding cover, the side plate is made of iron material, and the magnetic attraction pad is attracted in the sliding groove to form a sliding mounting structure for the sliding cover.

Further, the rotary adjustment valve comprises a rotary valve and a sealing gasket, the sealing gasket is fixed on an inner side surface of the rotary valve and is mounted on the side plate through an I-shaped fixed shaft to form a rotatable structure; openings overlapped with each other are arranged on the rotary valve and the sealing gasket, and the fixed shaft is positioned at the circle center of the arc formed by the first air vents; and an outer surface of the rotary valve is provided with a convex buckle with a spherical structure.

Further, a plurality of cavities such as an upper cavity and a lower cavity are arranged in the box body, one cavity corresponds to one group of first air vents or second air vents, and the first air vents and the rotary adjustment valves as well as the second air vents and the sliding adjustment valves are arranged on the side plates at two sides in a bilaterally symmetrical structure.

Further, the storage box further comprises a frame, and the bottom plate, the top plate and the side plates are fixedly mounted by the frame, and support legs are arranged on a bottom surface of the frame.

Further, brackets are respectively arranged on the two side frames below the bottom plate, and a pull-out plate that can be pulled out and placed is arranged on the brackets.

Further, the box door is assembled with the box body through a hinge and is made of a transparent glass plate; a smooth sealing surface is arranged around an opening of the cavity on the frame, a sealing ring is arranged around the box door, and the box door is attached to the sealing surface by the sealing ring after being covered to form a sealing structure for the cavity; and the box door is provided with a magnet, and the box door is tightly attracted to the box body by the magnet after being covered.

According to the present invention, the box body is provided with the first air vents and the second air vents, the first air vents are arranged regularly, and the second air vents are arranged in the sliding groove of the box body. The rotary adjustment valve is provided for the first air vents, the sliding adjustment valve is provided for the second air vents, the number or size of the first air vents exposed can be adjusted by rotating the rotary adjustment valve, and the number or size of the second air vents exposed can be adjusted by shifting the sliding adjustment valve, so that the ventilation volume of the air vents at two sides can be changed or even the air vents can be completely closed, and the freshness of bread can be further improved by controlling the convection of air flow to affect the change of air humidity. The rotary adjustment valve and the sliding adjustment valve both have a very simple structure, fewer parts and low cost, and are very convenient to mount, maintain and use.

Figure 1:
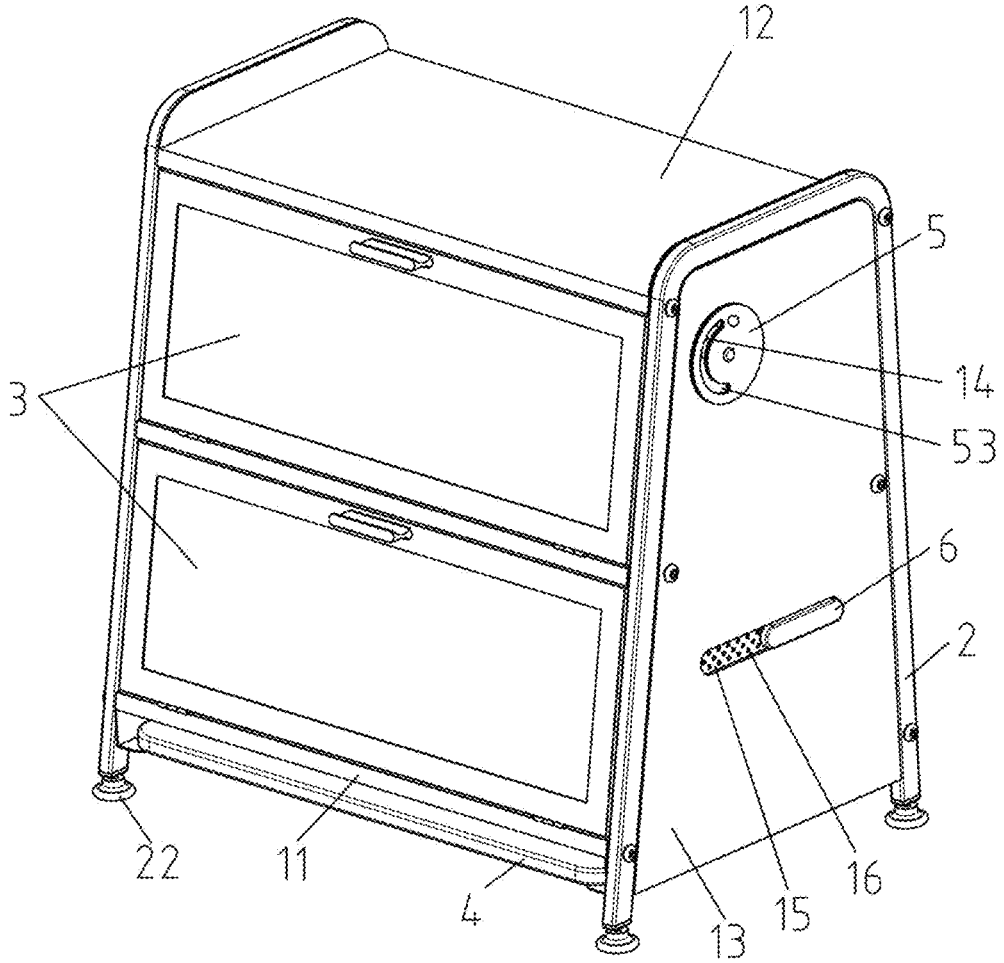
FIG. 1 is a diagram of an overall structure of the present invention.

In the drawings, 11: bottom plate, 12: top plate, 13: side plate, 14: first air vent, 15: sliding groove, 16: second air vent, 2: frame, 21: bracket, 22: support leg, 23: sealing surface, 3: box door, 31: sealing strip, 32: magnet, 4: pull-out plate, 5: rotary adjustment valve, 51: rotary valve, 52: sealing gasket, 53: opening, 54: convex buckle, 55: fixed shaft, 6: sliding adjustment valve, 61: sliding cover, and 62: magnetic attraction pad.

DETAILED DESCRIPTION OF EMBODIMENTS

Figure 2:
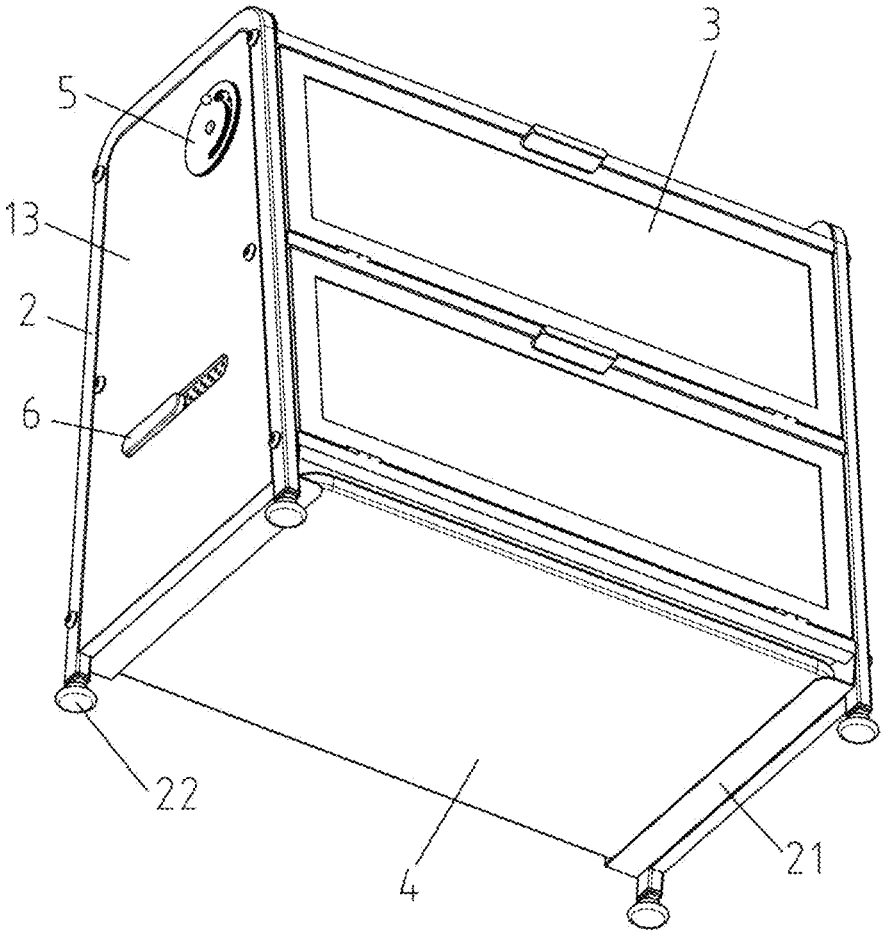
FIG. 2 is a diagram of an overall structure of the present invention from another angle.
Figure 3:
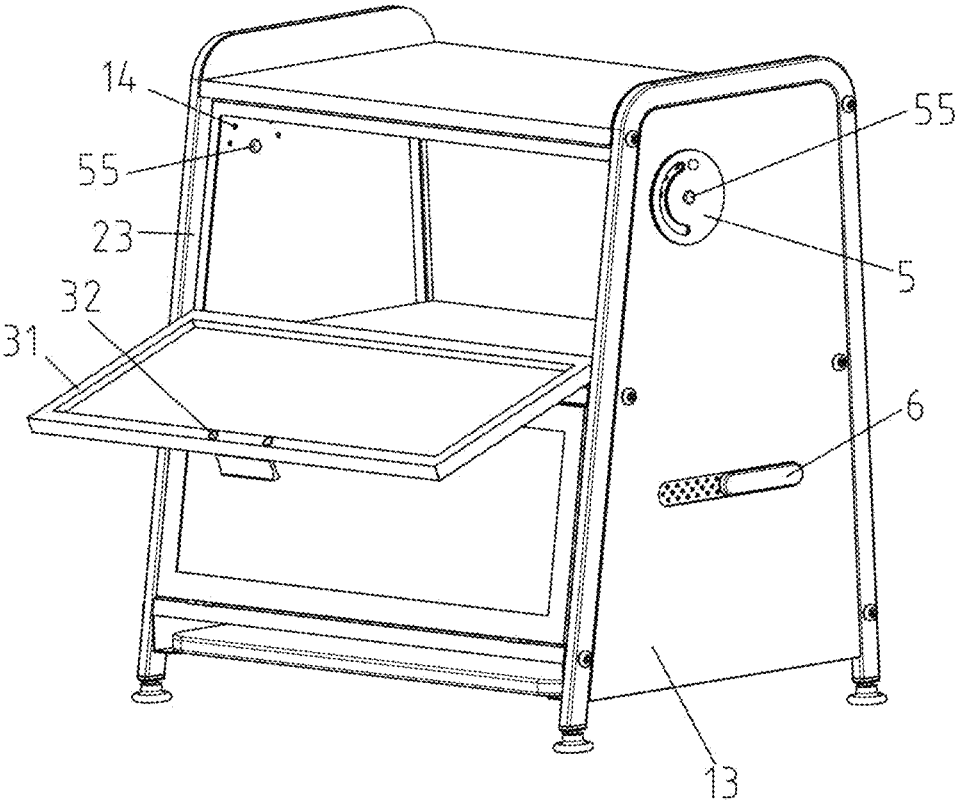
FIG. 3 is a structural diagram of the present invention with a box door opened.
Figure 4:
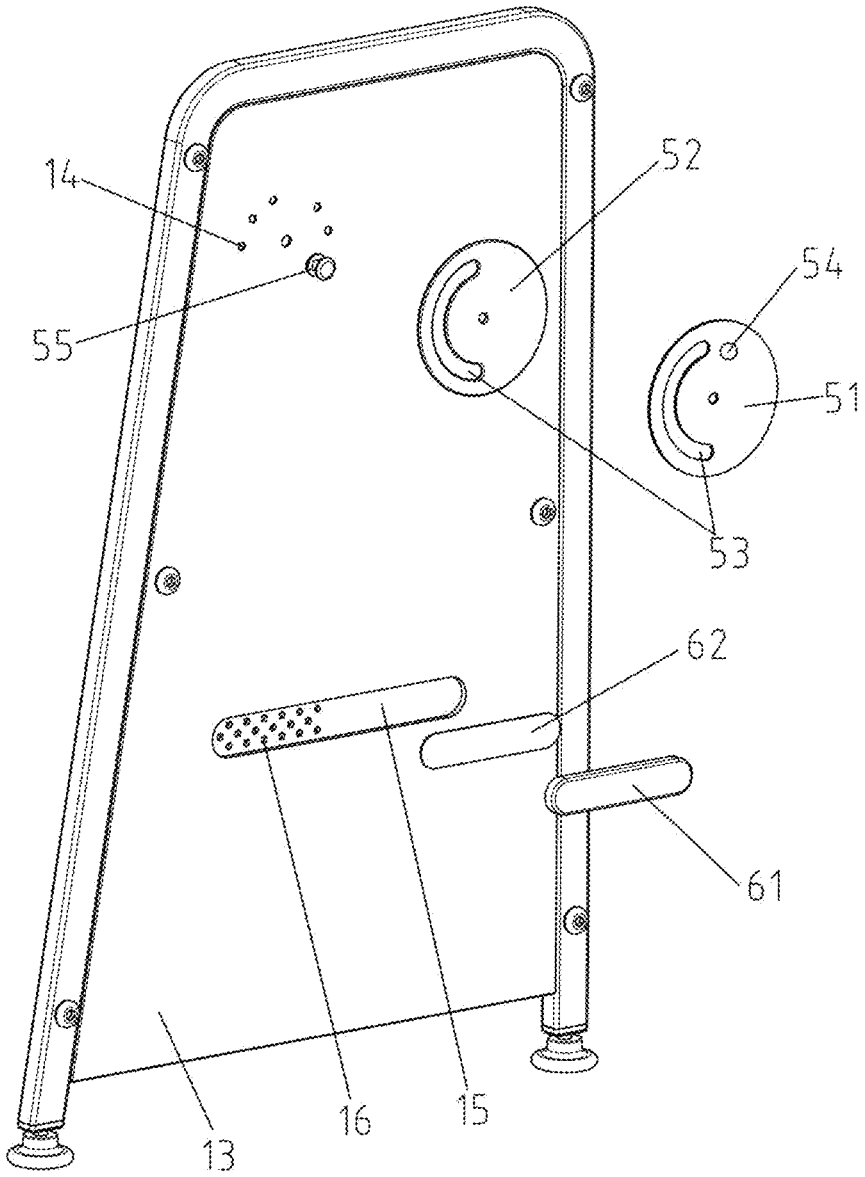
FIG. 4 is a diagram of an engagement structure of an air vent adjustment mechanism and a side plate.

In this embodiment, referring to FIGS. 1 to 4, a storage box with adjustable air vents comprises a box body and a box door 3, wherein the box door 3 is mounted on the box body, the box body is provided with first air vents 14, and the first air vents 14 are arranged regularly; a rotary adjustment valve 5 is arranged on the box body corresponding to the first air vents 14, and the first air vents 14 are communicated with the inside of the box body; the rotary adjustment valve 5 is provided with an opening 53 opposite to the first air vents 14, and an overlapping area between the opening 53 and the first air vents 14 is changed by rotating the rotary adjustment valve 5, namely the area covering the first air vents 14 is changed, so that the ventilation volume of the first air vents 14 is adjusted; the box body is provided with second air vents 16 and a sliding adjustment valve 6, and the second air vents 16 are communicated with the inside of the box body; and the sliding adjustment valve 6 is aligned with the second air vents 16, and an overlapping area between the sliding adjustment valve 6 and the second air vents 16 is changed by shifting the sliding adjustment valve, namely the area covering the second air vents 16 is changed, so that the ventilation volume of the second air vents is adjusted.

The box body comprises a bottom plate 11, a top plate 12 and side plates 13, and the first air vents 14, the second air vents 16, the rotary adjustment valve 5 and the sliding adjustment valve 6 are all arranged on each of the side plates 13.

Each of the side plates 13 is provided with a sliding groove 15, a plurality of the second air vents 16 are provided as small round holes, the second air vents 16 and the sliding adjustment valve 6 are all arranged in the sliding groove 15, and a length of the sliding adjustment valve 5 is less than that of the sliding groove 15, so that the sliding adjustment valve 6 can slide in the sliding groove 15.

A plurality of the first air vents 14 are provided as small round holes, and the second air vents 14 are arranged on the side plate 13 regularly.

The sliding adjustment valve 6 comprises a sliding cover 61 and a magnetic attraction pad 62, the magnetic attraction pad 62 is fixed on an inner surface of the sliding cover 61, the side plate 13 is made of iron material, and the magnetic attraction pad 62 is attracted in the sliding groove 15 to form a sliding mounting structure for the sliding cover 61, so that the sliding cover 61 can slide, and the assembly structure is simple.

The rotary adjustment valve 5 comprises a rotary valve 51 and a sealing gasket 52, the sealing gasket 52 is fixed on an inner side surface of the rotary valve 52 and is mounted on the side plate 13 through an I-shaped fixed shaft 55 to form a rotatable structure; openings 53 overlapped with each other are arranged on the rotary valve 51 and the sealing gasket 52, and the fixed shaft 55 is positioned at the circle center of the arc formed by the first air vents 14; and an outer surface of the rotary valve 51 is provided with a convex buckle 54 with a spherical structure, so that the rotary adjustment valve 5 can be rotated by shifting the convex buckle 54.

A plurality of cavities such as an upper cavity and a lower cavity are arranged in the box body, the upper cavity corresponds to two groups of first air vents 14 at the left and right sides, the lower cavity corresponds to two groups of second air vents 16 at the left and right sides, and the first air vents 14 and the rotary adjustment valves 5 as well as the second air vents 16 and the sliding adjustment valves 6 are arranged on the side plates 13 at two sides in a bilaterally symmetrical structure.

The storage box further comprises a frame 2, and the bottom plate 11, the top plate 12 and the side plates 13 are fixedly mounted by the frame 2, and support legs 22 are arranged on a bottom surface of the frame 2.

Brackets 21 are respectively arranged on the two side frames 2 below the bottom plate 11, and a pull-out plate 4 that can be pulled out and placed is arranged on the brackets 21, so that the pull-out plate can be pulled out and used conveniently at any time.

The box door 3 is assembled with the box body through a hinge, the box door 3 is made of a transparent glass plate; a smooth sealing surface 23 is arranged around an opening of the cavity on the frame 2, a sealing ring 31 is arranged around the box door 3, and the box door 3 is attached to the sealing surface 23 by the sealing ring 31 after being covered to form a sealing structure for the cavity; and the box door 3 is provided with a magnet 32, and the box door 3 is tightly attracted to the box body by the magnet 32 after being covered.

The box body and the box door 3 can be made of edible plastic materials or metal.

The present invention has been described in detail above. The above description is only a preferred embodiment of the present invention and should not limit the implementation scope of the present invention. That is, all equivalent changes and modifications made within the scope of the application should still fall within the scope of the present invention.

The invention claimed is:

1. A storage box with adjustable air vents, comprising a box body and a box door, wherein the box door is mounted on the box body, the box body is provided with first air vents arranged in an arc shape; a rotary adjustment valve is arranged on the box body, and the rotary adjustment valve is configured to cover the first air vents, and the first air vents are communicated with the inside of the box body; the rotary adjustment valve is provided with an opening opposite to the first air vents, and an overlapping area between the opening and the first air vents is changed by rotating the rotary adjustment valve, so as to form an adjusting structure for the ventilation volume of the first air vents; the box body is provided with second air vents and a sliding adjustment valve, and the second air vents are communicated with the inside of the box body; and the sliding adjustment valve is aligned with the second air vents, and an overlapping area between the sliding adjustment valve and the second air vents is changed by shifting the sliding adjustment valve, so as to form an adjusting structure for the ventilation volume of the second air vents;

wherein the box body comprises a bottom plate, a top plate and side plates, and the first air vents, the second air vents, the rotary adjustment valve and the sliding adjustment valve are all arranged on each of the side plates.

2. The storage box with the adjustable air vents according to claim 1, wherein each of the side plates is provided with a sliding groove, a plurality of the second air vents are provided, the second air vents and the sliding adjustment valve are all arranged in the sliding groove, and a length of the sliding adjustment valve is less than that of the sliding groove.

3. The storage box with the adjustable air vents according to claim 1, wherein a plurality of the first air vents are provided, and the second air vents are arranged on the side plate regularly.

4. The storage box with the adjustable air vents according to claim 2, wherein the sliding adjustment valve comprises a sliding cover and a magnetic attraction pad, the magnetic attraction pad is fixed on an inner surface of the sliding cover, the side plate is made of iron material, and the magnetic attraction pad is attracted in the sliding groove to form a sliding mounting structure for the sliding cover.

5. The storage box with the adjustable air vents according to claim 3, wherein the rotary adjustment valve comprises a rotary valve and a sealing gasket, the sealing gasket is fixed on an inner side surface of the rotary valve and is mounted on the side plate through an I-shaped fixed shaft to form a rotatable structure; openings overlapped with each other are arranged on the rotary valve and the sealing gasket, and the fixed shaft is positioned at the circle center of the arc formed by the first air vents; and an outer surface of the rotary valve is provided with a convex buckle with a spherical structure.

6. The storage box with the adjustable air vents according to claim 1, wherein a plurality of cavities are arranged in the box body, one cavity corresponds to one group of first air vents or second air vents, and the first air vents and the rotary adjustment valves as well as the second air vents and the sliding adjustment valves are arranged on the side plates at two sides in a bilaterally symmetrical structure.

7. The storage box with the adjustable air vents according to claim 1, further comprising a frame, wherein the bottom plate, the top plate and the side plates are fixedly mounted by the frame, and support legs are arranged on a bottom surface of the frame.

8. The storage box with the adjustable air vents according to claim 7, wherein brackets are respectively arranged on the two side frames below the bottom plate, and a pull-out plate that can be pulled out and placed is arranged on the brackets.

9. The storage box with the adjustable air vents according to claim 7, wherein the box door is assembled with the box body through a hinge and is made of a transparent glass plate; a smooth sealing surface is arranged around an opening of the cavity on the frame, a sealing ring is arranged around the box door, and the box door is attached to the sealing surface by the sealing ring after being covered to form a sealing structure for the cavity; and the box door is provided with a magnet, and the box door is tightly attracted to the box body by the magnet after being covered.

* * * * *